US005934353A

United States Patent [19]

Buhr

[11] Patent Number: 5,934,353

[45] **Date of Patent: *Aug. 10, 1999**

[54] ROLLABLE WINDOW SCREEN GUIDE ASSEMBLY

[75] Inventor: Terry J. Buhr, Pella, Iowa

[73] Assignee: Pella Corporation, Pella, Iowa

[ * ] Notice: This patent issued on a continued prosecution application filed under 37 CFR 1.53(d), and is subject to the twenty year patent term provisions of 35 U.S.C. 154(a)(2).

[21] Appl. No.: 08/848,230

[22] Filed: Apr. 30, 1997

[51] Int. Cl.[6] ..... E06B 9/17

[52] U.S. Cl. ..... 160/269; 160/273.1

[58] Field of Search ..... 160/269, 273.1, 160/41, 272, 271, 275, 276, 290.1, 23.1, 26, 121.1, 133

[56] References Cited

U.S. PATENT DOCUMENTS

| | | | |
|---|---|---|---|
| 2,769,491 | 11/1956 | Pitcoff | 160/269 X |
| 2,886,103 | 5/1959 | Pitcoff | 160/269 |
| 4,369,829 | 1/1983 | Casiday | 160/269 X |
| 4,531,562 | 7/1985 | Swanson | 160/269 X |
| 4,658,879 | 4/1987 | Van Klompenburg . | |
| 4,702,297 | 10/1987 | Van Klompenburg . | |
| 4,781,235 | 11/1988 | Hedstrom et al. | 160/269 |
| 4,987,943 | 1/1991 | Charest | 160/269 |
| 5,092,388 | 3/1992 | Evers . | |

*Primary Examiner*—David M. Purol

*Attorney, Agent, or Firm*—Hovey, Williams, Timmons & Collins

[57] ABSTRACT

A preferred fenestration assembly includes a roll screen and a guide body presenting channels for receiving the respective side edges of the screen. During movement of the screen toward the closed position, the side edges are gripped between a shiftable gripper and gripping surfaces of the guide body. The gripping components are configured to release the side edges if excessive force is applied to the screen to prevent damage while retaining the side edges with a minimum level of force to withstand wind loading.

10 Claims, 3 Drawing Sheets

ROLLABLE WINDOW SCREEN GUIDE ASSEMBLY

BACKGROUND OF THE INVENTION

1. Field of the Invention

The present invention relates to the field of fenestration products. More particularly, the invention is concerned with a preferred fenestration assembly including a roll screen and a guide body presenting channels for receiving the respective side edges of the screen. During movement of the screen toward the closed position, the side edges are gripped between a shiftable gripper and gripping surfaces of the guide body. The gripping components are configured to release the side edges if excessive force is applied to the screen to prevent damage while retaining the side edges with a minimum level of force to withstand wind loading.

2. Description of the Prior Art

In the prior art, various configurations have been devised for holding the side edges of a roll screen when in the closed position. In general, these have functioned well. However, none of the prior art configurations have provided the ability to hold the side edges of the screen sufficiently to withstand wind loading while at the same time releasing the side edges upon the imposition of excessive force on the screen in order to prevent damage.

SUMMARY OF THE INVENTION

The present invention solves the prior art problems discussed above and provides a distinct advance from the state of the art. In particular, the roll screen guide assembly hereof holds the side edges of the screen with sufficient force to withstand wind loading while releasing the edges if excessive force is applied that would damage the screen if not released.

In the preferred embodiment, a guide assembly presents guide channels for receiving the respective side edges of the roll screen. Gripping surfaces are defined adjacent each guide channel. A gripper is coupled in each channel and presents gripper surfaces for engaging a screen edge. In the gripping position, the screen edge is gripped between the gripper surfaces and the guide channel gripping surfaces. These surfaces are preferably configured to grip the screen edge sufficiently to hold against five pounds of force exerted on the center of the screen surface, or the equivalent, but to release at ten pounds of force in order to prevent screen damage.

At least one hinge arm intercouples the gripper and the guide body in a parallelogram linkage in order to allowing shifting of the gripper between the gripping position and a retracted position. As the pull bar of the roll screen nears the closed position, it engages a hook extending from the gripper and shifts the gripper to the gripping position as the screen shifts to the closed position. When the screen is released and shifts toward the open position, the hook is disengaged and the gripper shifts to the retracted position under the bias of springs coupled with the hinge arms.

DETAILED DESCRIPTION OF THE PREFERRED EMBODIMENT

Figure 1:
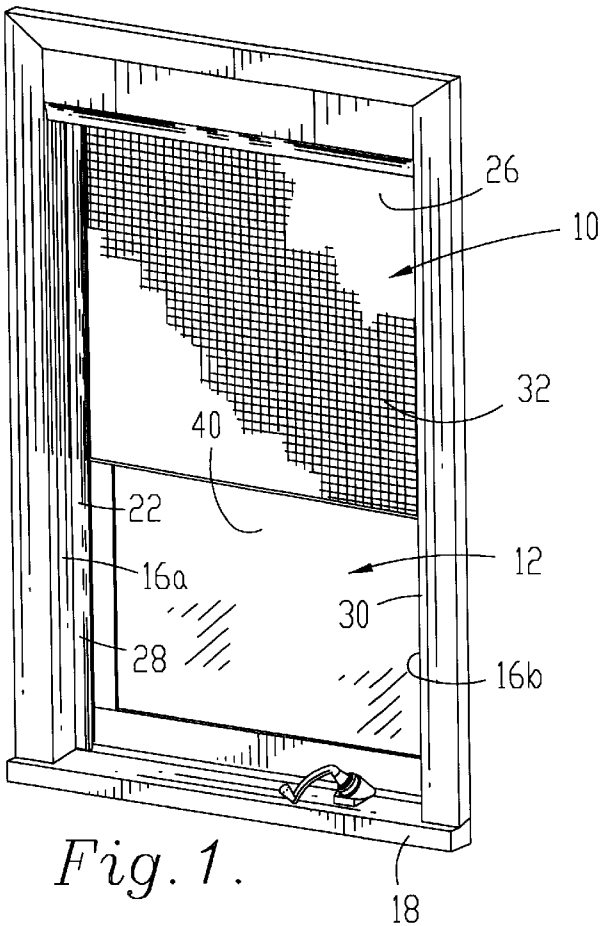
FIG. 1 is a perspective view of the preferred fenestration apparatus of the present invention shown installed in conjunction with a window.

Referring to the drawing figures, FIG. 1 is a perspective view of fenestration apparatus 10, preferably in the nature of a roll screen, mounted on the interior side of casement window 12. FIG. 1 also illustrates apparatus 10 and window 12 in relation to various framing components including head 14, left, right jambs 16*a* and 16*b*, sill 18 and sill stop 20. Preferred apparatus 10 broadly includes frame 22 and screen assembly 24.

Frame 22 includes cover 26, left guide assembly 28 and right guide assembly 30. Screen assembly 24 includes screen 32 preferably composed of fiberglass as a flexible sheet with the upper end connected to roller 34 and pull handle assembly 36 connected to the lower end of sheet 32.

Figure 2:
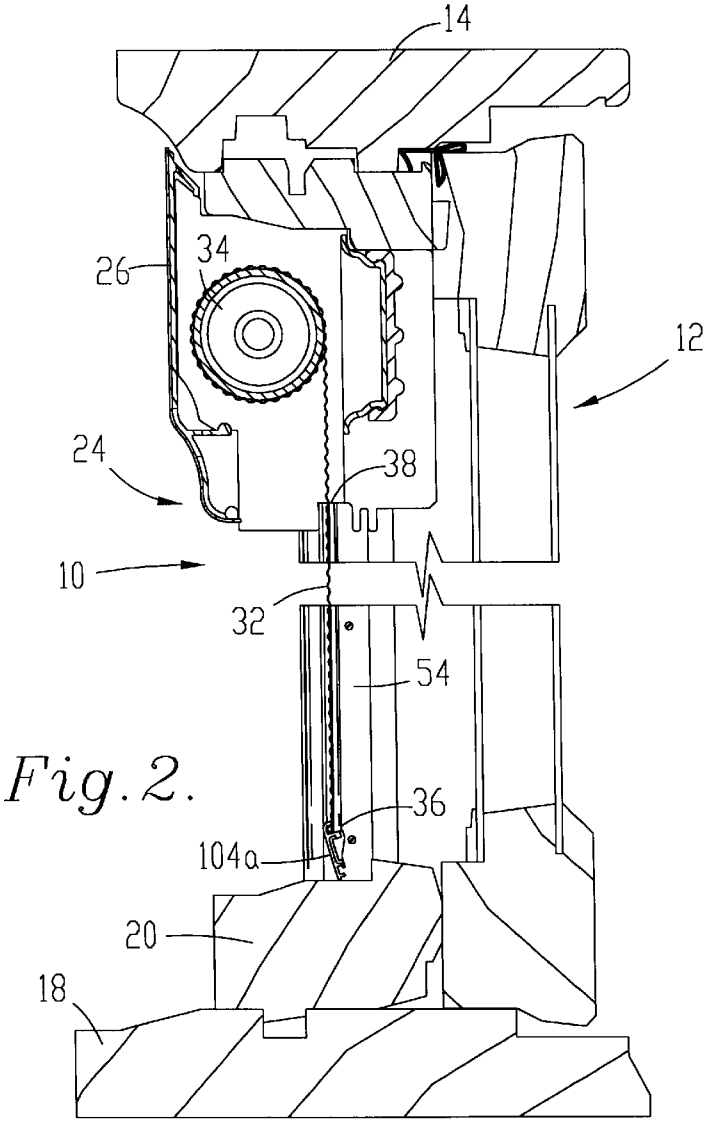
FIG. 2 is a shortened, side sectional view of the apparatus of FIG. 1.

Cover 26 encloses roller 34, and presents slot 38 through which screen 32 extends from roller 34 as best viewed in FIG. 2. Left guide assembly 28 is connected to left jamb 16*a* and right guide assembly 30 is connected to right jamb 16*b*. Assemblies 28, 30 are identical except for being left-right reversed, that is, mirror images of one another and accordingly, only left guide assembly 28 is described in detail. Cover 26 and assemblies 28, 30 cooperatively define opening 40.

Figure 3:
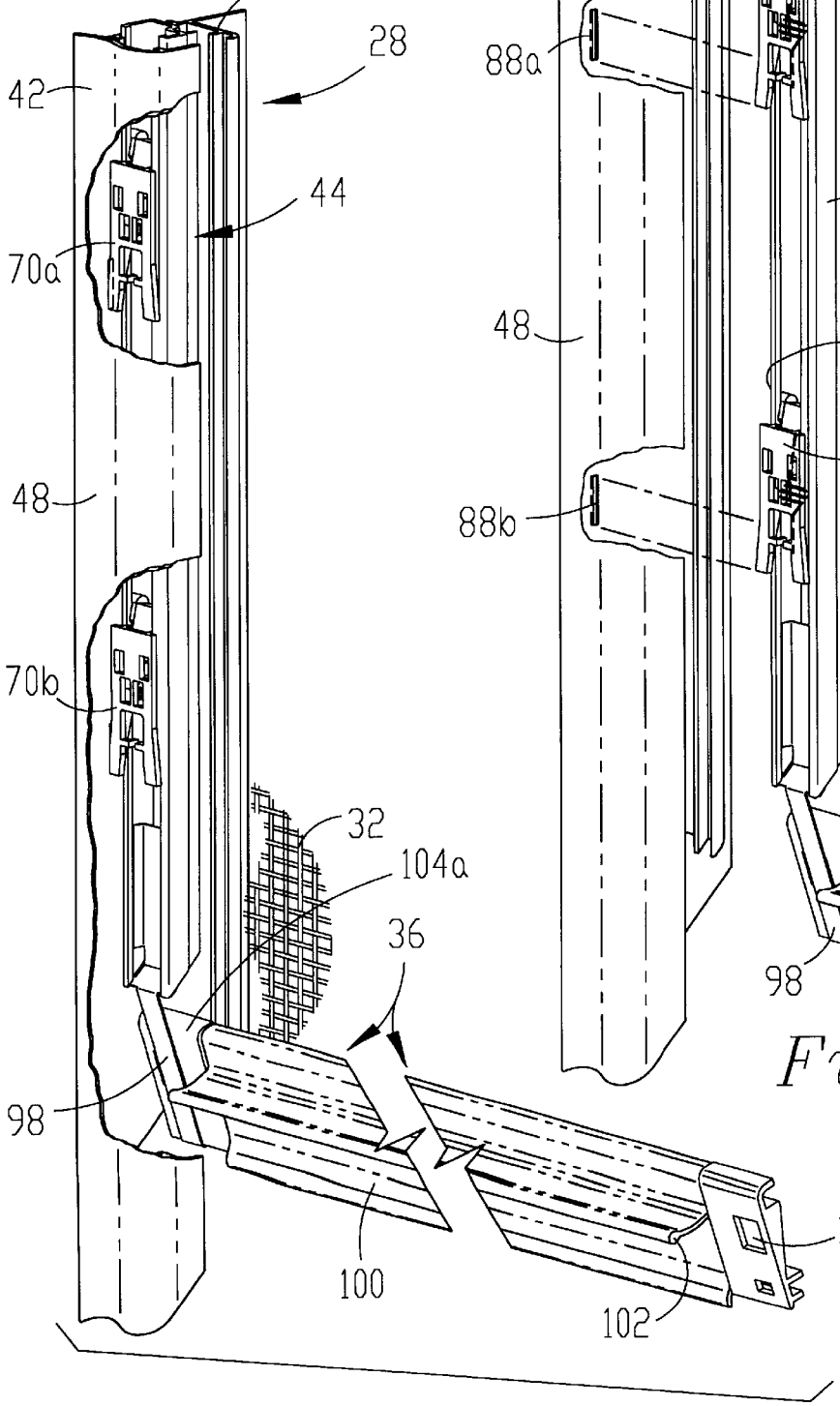
FIG. 3 is a perspective view of the left frame member of the apparatus of FIG. 1 with portions cut away for clarity and shown in relationship with a portion of the screen and the pull bar.
Figure 4:
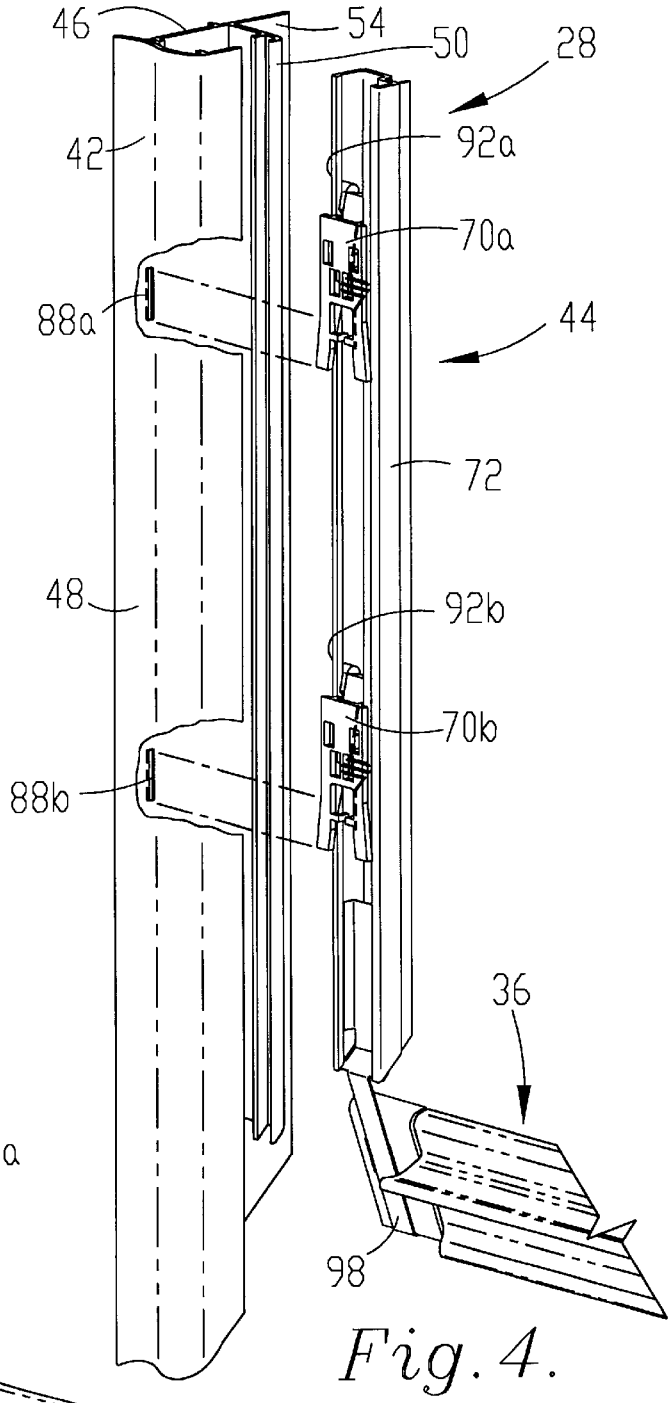
FIG. 4 is a disassembled view of the gripper assembly and left frame member of FIG. 3.

Left guide assembly 28 includes integral guide body 42, preferably composed of extruded aluminum and locking assembly 44 (FIGS. 3 and 4). As best viewed in FIGS. 3–4 and 7–8, guide body 42 includes wall 46, L-shaped support wall 48 and guide wall member 50. Generally planar wall 46 is configured so that the outboard surface can engage jamb 16*a* with nails or screws through flange 54 to secure left guide assembly 28 to jamb 16*a*. Mounting could also be accomplished by a snap in arrangement either directly to the wood or body of the window, to a plastic mounting bracket, or to a mounting strip.

Support wall 48 extends transversely across mounting wall 46 and includes cover flange 56 covering the front of jamb 16*a*, front wall 58 extending transversely to mounting wall 46, and side wall 60 completing the L-shaped configuration and extending generally parallel to mounting wall 46 as illustrated, terminating at channel edge 62. Support wall 48 also includes interior, inwardly extending ridges 64*a* and 64*b*, which cooperate with front wall 58 to define respective grooves 66*a* and 66*b*.

Guide wall member 50 extends from the inboard side of mounting wall 46 between support section 52 and flange 54. The distal side of guide wall 50 includes spaced, gripping ribs 68*a* and 68*b* extending toward front wall 58.

Figure 8:
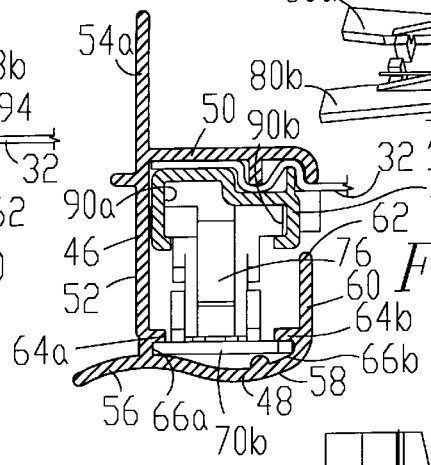
FIG. 8 is a partial sectional view taken along line 8—8 of FIG. 6.
Figure 9:
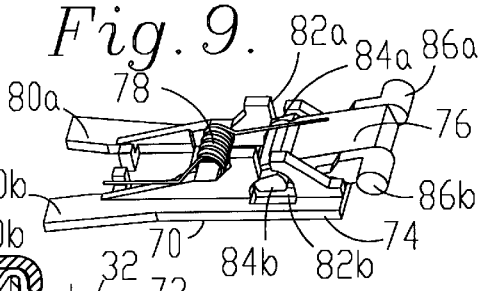
FIG. 9 is a perspective view of the hinge body of the apparatus of FIG. 1.
Figure 5:
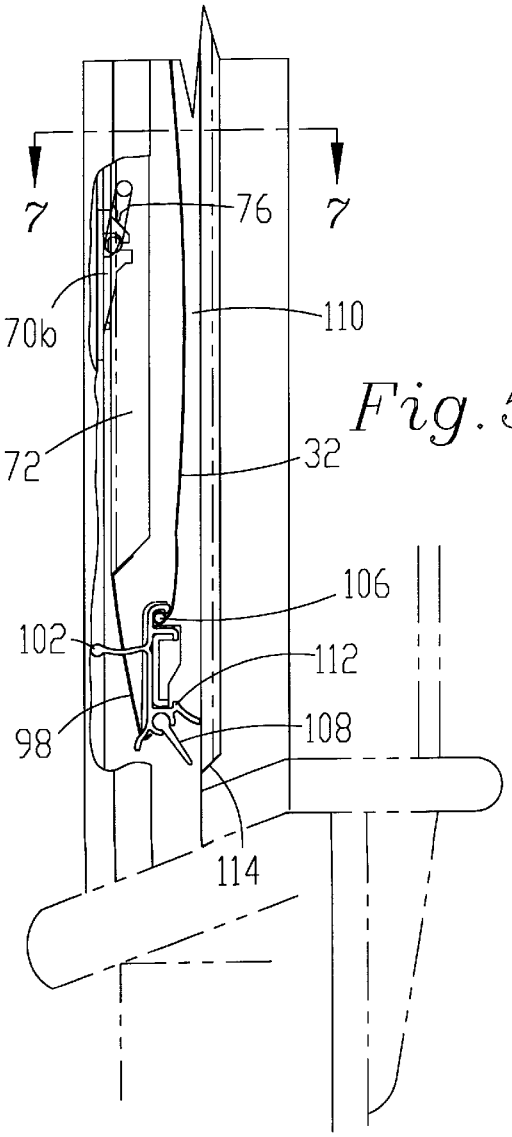
FIG. 5 is a partial side sectional view of the screen, pull bar guide and left frame member with portions cut away for clarity and with the sill and sill stop in phantom lines, and showing the pull bar guide engaging the gripper hook while in the unlocked position.
Figure 6:
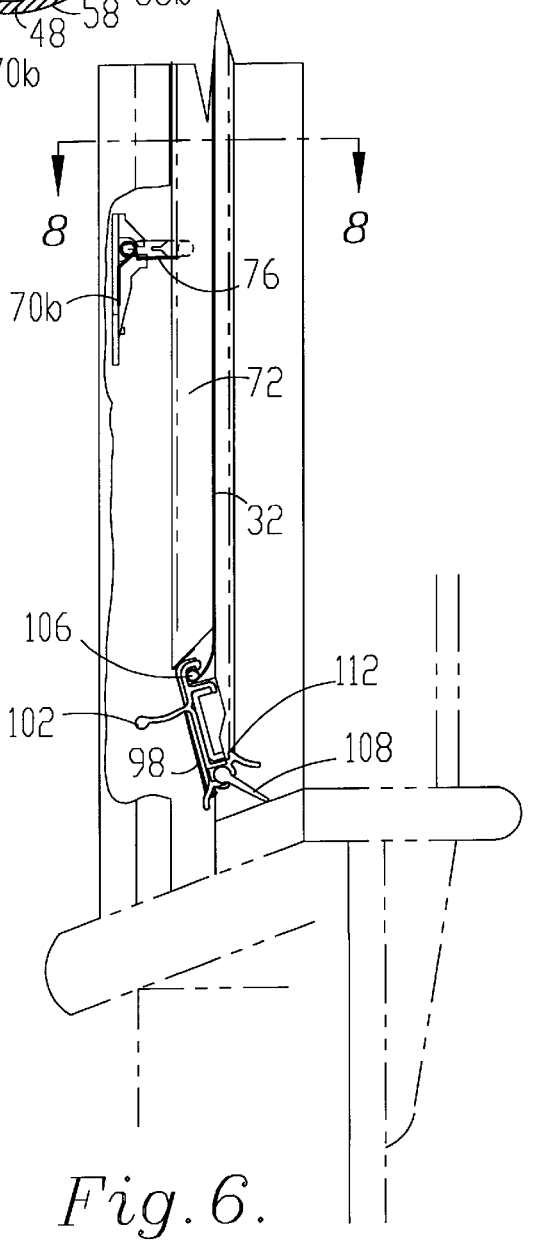
FIG. 6 is a view similar to FIG. 5 but showing the pull bar guide and gripper in the locked position.

Locking assembly 44 includes hinge bodies 70 individually designated 70*a* and 70*b* (see FIGS. 3 and 4) and further includes gripper bar 72. As best viewed in FIG. 9, hinge link body 70 includes base 74, hinge arm 76 and return spring 78. Base 74 includes positioning legs 80*a* and 80*b* and upstanding, spaced ridges configured to define respective pivot holes 82*a* and 82*b*. Hinge link arm 72 includes outwardly extending pivot ears 84*a* and 84*b* respectively received in pivot holes 82*a* and 82*b* for allowing pivoting motion of hinge link arm 76 between a retracted position illustrated in FIGS. 3–5, 7 and 9, and a gripping position as illustrated in FIGS. 6 and 8. As apparent, the pivot ears 84*a* and 84*b* adapt the link arms 76 for swinging movement about an axis transverse to the path of travel of the screen 32. The end of hinge link arm 76 opposite legs 80*a,b* includes outwardly extending pivot knobs 86*a* and 86*b*. Return spring 78 biases hinge link arm 76 toward the retracted position.

Referring to FIGS. 3–4 and 7–8, hinge base 74 is configured so that the opposed side edges snugly slide in grooves 66*a,b* into a position whereby positioning leg 80*a* snaps into a respective slot 88*a* or 88*b* defined in support section 52 as illustrated in FIGS. 3 and 4. This prevents downward slipping of hinge bodies 70*a,b* during operation, discussed below.

Figure 7:
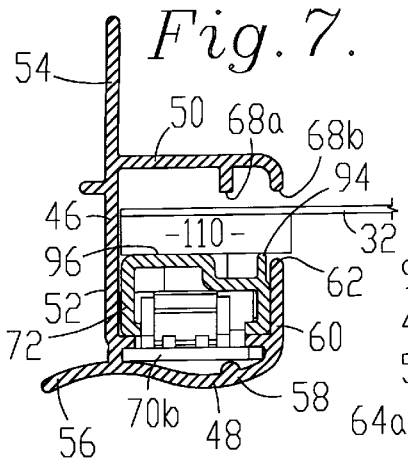
FIG. 7 is a partial sectional view taken along line 7—7 of FIG. 5.

Integral gripper bar 72 is preferably composed of extruded aluminum and configured to fit within guide body 42 and in particular, within the space defined by support section 52, front wall 58 and side wall 60, as illustrated in FIG. 7. Moreover, gripper bar 72 is configured to shift within guide body 42 between a retracted position as illustrated in FIGS. 5 and 7, and a clamping position illustrated in FIGS. 6 and 8.

The side of gripper bar 72 toward front wall 58 includes coupling channels 90*a* and 90*b* opening toward one another. Channels 90*a,b* are spaced and configured to receive pivot knobs 86*a,b* of respective hinge bodies 70*a,b* thereby coupling gripper bar 72 with hinge bodies 70*a,b*. Coupling channel 90*a* includes spaced coupling holes 92*a* and 92*b* configured for receiving pivot knobs 86*a,b* of respective hinge bodies 70*a,b*. This prevents slidable movement of gripper 72 with respect to pivot knobs 86*a,b* while still allowing pivot motion. With the structure described, gripper bar 72, hinge bodies 70*a,b* and support section 52 of support wall 48 form a four bar parallelogram linkage allowing gripper bar 72 to shift between the retracted position shown in FIGS. 5 and 7, and the clamping position shown in FIGS. 6 and 8 with return spring 78 biasing gripper bar 72 and thereby gripping assembly 44 toward the retracted position.

The side of gripper bar 72 toward guide wall 50 presents gripping ridge 94 configured for registration with the space between gripping ribs 68*a,b* of guide wall 50. Gripper bar 72 is also configured to present a space for receiving gripping rib 68*a*, and to present gripping flat 96. Gripping ribs 68*a,b*, rib 94 and gripping flat 96 cooperatively present surfaces for engaging and gripping screen 32 as discussed further below.

Gripping assembly 44 further includes locking hook 98 coupled with the lower end of gripper bar 72 as best viewed in FIGS. 3–4 and 5–6. Locking hook 98 is preferably composed of steel.

The upper end of screen 32 is connected to roller 34 having an internal spring (not shown) in the nature of a conventional window shade for biasing toward a rolled up position. In this position, screen 32 is in an uncovered position relative to opening 40. Roller 34 allows the dispensing of screen 32 through slot 38 toward a covered position in which screen 32 is in a covering relationship with opening 40.

Pull handle assembly 36 is connected to the lower end of screen 32. Assembly 36 includes extruded aluminum handle 100 presenting outwardly extending, integral pull bar 102, screen guides 104*a* and 104*b* coupled with handle 100 at the opposed ends thereof, spline 106 connecting screen 32 with handle 100, and sweep strip 108 connected with the lower edge of handle 100 and extending toward sill stop 20.

The width of screen 32 is such to extend substantially between mounting walls 46 of left and right guide assemblies 28, 30. In particular, the side edges of screen 32 are received between guide wall 50 and gripper bar 72, which define guide channel 110 therebetween. Screen guides 104*a,b* are connected with screen 32 adjacent the respective side edges and are thereby also received in guide channel 110.

In use, and with screen 32 in the rolled up position, opening 40 is uncovered and handle assembly 36 is adjacent the exterior of slot 38. Also, gripper bar 72 is in the retracted position.

To shift screen 32 to the covered position, the user grasps pull bar 102 and pulls downwardly against the bias of roller 34. As screen 32 moves downwardly, the side edges thereof and screen guides 104*a,b* also move downwardly in guide channel 110. As screen guides 104*a,b* near the bottom of opening 40, the leading edges; of guides 104*a,b* engage the respective locking hooks 98 of left and right guide assemblies 28,30, as illustrated in FIG. 5.

Continued downward movement of guides 104*a,b* pulls the respective gripper bars 72 downwardly, which shifts gripper bars 72 toward the clamping position illustrated in FIGS. 6 and 8. At the completion of downward movement, that is, when screen 32 covers opening 40, respective locking tabs 112 of screen guides 104*a,b* slip over and engage the lower edges 114 of guide wall 50, as illustrated in FIG. 6. Locking hook 98 is biased in this direction and the leverage of the user on pull bar 102 also urges locking tab 112 into position below lower edge 114. When the user releases pull bar 102, the bias provided by return springs 78 of hinge bodies 70*a,b*, by hooks 98, and by roller 34 maintains tab 112 engaged with edge 114, and thereby maintains gripper bar 72 in the gripping position.

In the clamping position as illustrated in FIG. 8, hinge link arms 76 are substantially perpendicular to gripper bar 72 and thereby force the gripper bar 72 into clamping relationship with wall member 50. The edges of the screen thus become clamped between the bars 72 and the members 50. Gripping ribs 68*a,b*, rib 94 and gripping flat 96 cooperate as gripping components to grip the respective side edges of screen 32 and seal these edges against entry of insects and the like. Moreover, the gripping components are configured to provide sufficient friction relative to the side edges of screen 32 in order to hold these edges against a force of at least 5 pounds and preferably about 10 pounds exerted on the center of either opposed face of screen 32, or the equivalent. A minimum level force of 5 pounds is critical so that the screen edges are retained against wind forces between about 25 and 30 miles per hour. However, if a greater level of force is encountered by screen 32 (greater than 10 pounds in the preferred embodiment) the side edges release from the gripping surfaces. This level of release force is below the level at which damage could occur to the screen and by releasing screen 32, damage is prevented.

Those skilled in the art will appreciate that the level of release force can varied to accommodate other screen materials or other types of materials used to cover opening 40. The level of 10 pounds is preferred in accordance with the preferred fiberglass screen.

If force above 10 pounds is exerted on screen 32 and the side edges pulled loose from the gripping surfaces, screen 32 is easily reconfigured by opening the screen and reclosing it. By pulling upwardly on pull 102, screen guides 104*a,b* are released from lower edge 114. As screen guides 104*a,b* move upwardly, gripper bar 72 returns to the retracted position under the bias of return springs 78. While this is occurring, screen 32 is being rolled as it is retracted on roller 34. After reaching the rolled up position, screen 32 can be returned to the covering, or closed position, as described above. This process realigns the side edges of screen 32 in channel 110.

Having thus described the preferred embodiment of the present invention, the following is claimed as new and desired to be secured by Letters Patent:

1. A fenestration apparatus comprising:

a frame presenting an open area;

a sheet of flexible material configured for covering said open area, said sheet presenting opposed side edges and opposed faces and being movable in a path of travel extending across said open area between an open position substantially uncovering said open area and a closed position substantially covering said open area, said frame including a pair of elongated members along opposite lateral extremities of said open area;

a pair of actuatable, elongated gripping bars along said opposite lateral extremities of the open area in spaced opposition to respective ones of said members, said sheet being disposed to position its side edges within the space between the members and the gripping bars as the sheet is opened and closed;

a plurality of link arms shiftably mounting the bars on the frame and swingable about axes projecting transversely of said path of travel of the sheet for movement of the bars into and out of clamping ralationship with the members; and actuating structure associated with the sheet and the bars in disposition for operable interengagement as the sheet approaches its closed position for actuating the bars to releasably clamp and retain the sheet against the members.

2. The apparatus as set forth in claim 1, said gripping bars and said members being disposed for releasing said side edges at the equivalent of a force of about 10 pounds on the center of one of said sheet faces.

3. The apparatus as set forth in claim 1, said sheet presenting a lower edge and a handle coupled therewith, said actuating structure including a hook on each grippinq bar and guides on the handle disposed for engaging the hooks during movement of said sheet toward said closed position.

4. The apparatus as set forth in claim 1, said sheet being composed of screen material.

5. The apparatus as set forth in claim 1, said sheet being retracted onto a roller in said open position.

6. The apparatus as set forth in claim 1, said sheet being a roll screen.

7. The apparatus as set forth in claim 1, said gripping bars and said members including gripping ribs configured for placing said side edges in a serpentine configuration when said gipping bars are in said clamping relationship for frictionally holding said side edges.

8. The apparatus as set forth in claim 1, each gripping bar having a pair of said link arms joined with a corresponding member and gripping bar in a four-bar linkage relationship.

9. The apparatus as set forth in claim 8, said link arms of each four-bar linkage being parallel to one another.

10. The apparatus as set forth in claim 1; and return spring mechanism operably coupled with each of said gipping bars for yieldably biasing the bar away from the member.

* * * * *